US009543104B2

(12) United States Patent
Belisle et al.

(10) Patent No.: US 9,543,104 B2
(45) Date of Patent: Jan. 10, 2017

(54) FUSE ASSEMBLIES

(71) Applicant: Hamilton Sundstrand Corporation, Charlotte, NC (US)

(72) Inventors: Francis C. Belisle, Roscoe, IL (US); John N. Buzzard, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 14/689,148

(22) Filed: Apr. 17, 2015

(65) Prior Publication Data

US 2016/0307721 A1 Oct. 20, 2016

(51) Int. Cl.
*H01H 85/50* (2006.01)

(52) U.S. Cl.
CPC ..... *H01H 85/50* (2013.01)

(58) Field of Classification Search
CPC ..... H01R 13/207; H01R 13/621; H01R 4/302; H01R 11/283; H01R 11/282; H01H 85/50
USPC ..... 439/890, 364, 366, 620.33, 620.34, 830,439/727, 765, 771, 791, 793, 801
See application file for complete search history.

(56) References Cited

U.S. PATENT DOCUMENTS

| | | | | | |
|---|---|---|---|---|---|
| 1,005,253 | A | | 10/1911 | Mallory | |
| 1,881,351 | A | | 10/1932 | Bussmann | |
| 2,059,467 | A | * | 11/1936 | Lowenstein | H01H 85/202 337/215 |
| 2,448,267 | A | * | 8/1948 | Landmeier | H01H 85/204 439/830 |
| 2,556,018 | A | | 6/1951 | Von Hoorn | |
| 2,727,109 | A | * | 12/1955 | Von Hoorn | H01H 85/055 337/165 |
| 3,179,772 | A | | 4/1965 | Sommers | |
| 3,611,249 | A | * | 10/1971 | Lovrenich | H01R 12/515 248/506 |
| 4,106,843 | A | * | 8/1978 | Salzer | H01R 4/302 439/801 |
| 4,538,879 | A | | 9/1985 | Wagener | |
| 5,293,147 | A | * | 3/1994 | Oh | H01H 69/02 337/201 |

(Continued)

FOREIGN PATENT DOCUMENTS

| | | |
|---|---|---|
| DE | 10009605 | 10/2000 |
| GB | 658882 | 10/1951 |
| GB | 713456 | 8/1954 |

OTHER PUBLICATIONS

Extended European Search Report dated Sep. 27, 2016, issued during the prosecution of European Patent Application No. 16165672.3 (7 pages).

*Primary Examiner* — Tulsidas C Patel
*Assistant Examiner* — Travis Chambers
(74) *Attorney, Agent, or Firm* — Locke Lord LLP; Scott D. Wofsy; Alicia J. Carroll

(57) ABSTRACT

A fuse assembly includes a bus bar fuse and a clip. The bus bar fuse has a leg with a slotted opening. The clip surrounds a portion of the leg. The clip includes a first side having a threaded through-hole and a second side extending from the first side at an angle with respect to the first side. A third side extends from the second side at an angle with respect to the second side. The third side includes a through-hole. The threaded through-hole of the clip provides for captivation of the fastener within the clip when mounting the fuse assembly to the fuse mounting block assembly.

14 Claims, 1 Drawing Sheet

(56) References Cited

U.S. PATENT DOCUMENTS

| | | | | |
|---|---|---|---|---|
| 5,951,223 | A * | 9/1999 | Lindquist | F16B 37/02 411/104 |
| 6,004,159 | A * | 12/1999 | Liang | H01R 11/22 439/620.27 |
| 6,234,850 | B1 * | 5/2001 | Pandit | H01R 4/34 439/801 |
| 7,234,968 | B2 * | 6/2007 | Lottmann | H01H 85/204 439/771 |
| 7,347,733 | B2 * | 3/2008 | Murakami | H01H 85/044 439/620.27 |
| 7,736,187 | B2 | 6/2010 | Yaworski et al. | |

* cited by examiner

FUSE ASSEMBLIES

BACKGROUND OF THE INVENTION

1. Field of the Invention

The present invention relates to electrical fuses, and, in particular, to bus bar fuse assemblies.

2. Description of Related Art

Traditional large amperage electrical fuses have copper bus bar ends or legs with slotted openings for going over threaded studs. The installation of the fuses into electrical assemblies typically requires the handling and installation of loose nuts and washers with the fuse mounted onto terminal studs. When bolts are used to secure the fuse to mounting bases, the fasteners, washers and fuse have to be held while starting the thread. This results in a risk of losing hardware within the assembly, potentially resulting in foreign object damage threat, e.g. in aerospace applications, or having washers slip under the fuse bus bar ends and being in the electrical joint potentially causing higher heating due to voltage drop.

Such conventional methods and systems have generally been considered satisfactory for their intended purposes. However, there is still a need in the art for systems and methods that allow for improved fuse assemblies. The present invention provides a solution for these needs.

SUMMARY OF THE INVENTION

A fuse assembly includes a bus bar fuse and a clip. The bus bar fuse has a leg with a slotted opening. The clip surrounds a portion of the leg. The clip includes a first side having a threaded through-hole and a second side extending from the first side at an angle with respect to the first side. A third side extends from the second side at an angle with respect to the second side. The third side includes a through-hole.

It is contemplated that the fuse assembly can include a fastener passing through the threaded through-hole of the first side of the clip, the through-hole of the third side of the clip, and the slotted opening of the leg of the bus bar fuse. A portion of the fastener can be surrounded about its periphery by the threaded through-hole of the first side and the through-hole of the third side to retain the fastener within the leg of the bus bar fuse. The fastener can include a threaded portion, wherein the diameter of the through-hole of the third side is larger than the diameter of threads of the fastener to provide clearance for the threaded portion of fastener to pass through. The threaded portion can correspond to threads of the threaded through-hole of the first side such that to pass through the threaded through hole the fastener must be rotated.

At least one of the first and third sides includes a lip to guide the clip onto the bus bar fuse and to restrict motion of the clip when assembled onto the bus bar fuse. The lip can extend from the first side of the clip toward the third side of the clip, and/or from the third side of the clip toward the first side of the clip. The slotted opening of the leg can open in a direction facing away from the second side of the clip, and/or in a direction ninety degrees from the second side of the clip.

A fuse block assembly includes a fuse mounting block body assembly having a threaded female mating portion extending therefrom. The fuse block assembly includes a bus bar fuse, as described above, including a leg operatively connected to the fuse mounting block body assembly. The clip, as described above, surrounds a portion of the leg. The fuse block assembly includes a fastener, as described above, threaded into the fuse mounting block body assembly. The clip is configured to retain the fastener within the leg of the bus bar fuse when not threaded into the fuse mounting block body assembly. The threaded female mating portion can be a cylindrical electrical post with a threaded hole therethrough.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
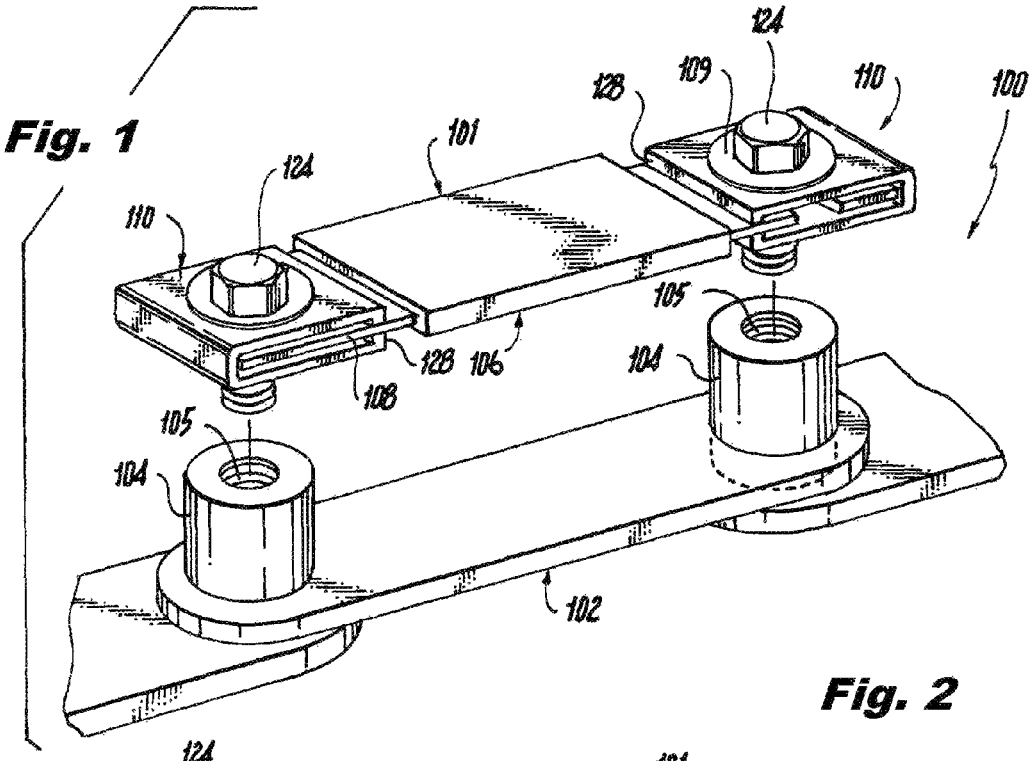
FIG. 1 is a perspective exploded view of an exemplary embodiment of a fuse block assembly constructed in accordance with the present disclosure, showing the fuse assembly being threaded into the fuse block.

Reference will now be made to the drawings wherein like reference numerals identify similar structural features or aspects of the subject disclosure. For purposes of explanation and illustration, and not limitation, a schematic view of an exemplary embodiment of a fuse block assembly in accordance with the disclosure is shown in FIG. 1 and is designated generally by reference character 100. Other embodiments of fuse block assemblies in accordance with the disclosure, or aspects thereof, are provided in FIGS. 2-3, as will be described. The embodiments of fuse block assembly 100 and aspects thereof provide for captivation of a threaded bolt onto legs of a fuse, allowing the fastener hardware (bolts, washers, etc.) to be assembled onto the fuse in a more visible and controlled location prior to assembly installation in, for example, an aircraft. This tends to reduce assembly error and reduces the potential for foreign object damage due to lost hardware.

As shown in FIG. 1, a fuse block assembly 100 includes a fuse mounting block body assembly 102 having a threaded female mating portion 104 extending therefrom and a fuse assembly 101. Threaded female mating portion 104 is a cylindrical electrical post with a threaded hole 105 therethrough. Fuse assembly 101 includes a bus bar fuse 106 including two legs 108 operatively connected to fuse mounting block body assembly 102. Clips 110 surround a portion of each leg 108. Fuse assembly 101 includes a fastener 124 for threading into fuse mounting block body assembly 102. Those skilled in the art will readily appreciate that clips 110 are conductive and can be made from a variety of conductive metallic materials, such as, copper alloy, brass, aluminum, or the like.

Figure 2:
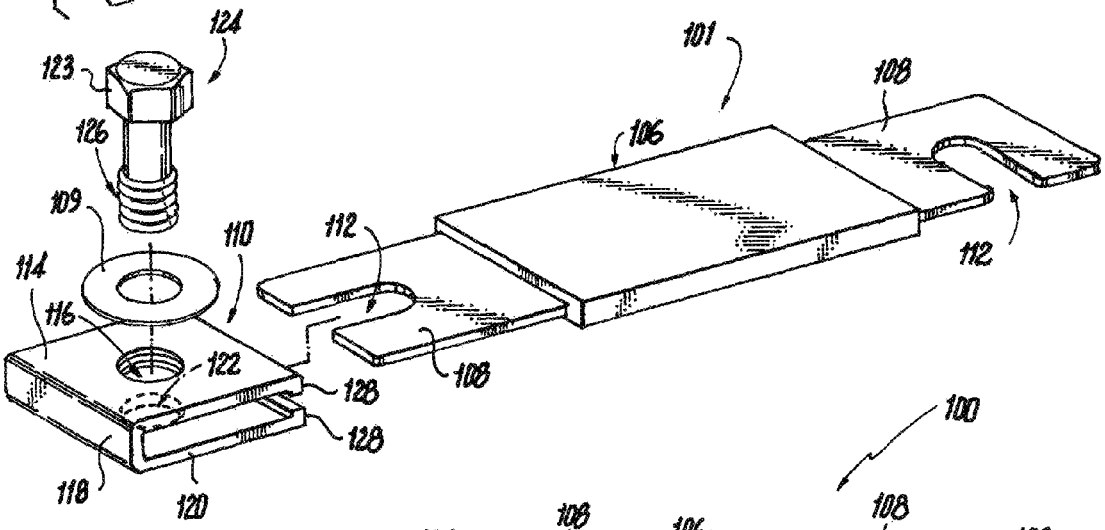
FIG. 2 is a perspective exploded view of the fuse assembly of FIG. 1, showing the clip and the fastener.

With reference now to FIG. 2, each leg 108 includes a slotted opening 112. Each clip 110 includes a first side 114 having a threaded through-hole 116. Clip 110 includes a second side 118 extending from first side 114 at an angle with respect to first side 114. A third side 120 extends from second side 118 at an angle with respect to second side 118. Third side 120 includes a through-hole 122.

With continued reference to FIG. 2, fastener 124 passes through threaded through-hole 116 of first side 114 of clip 110, through-hole 122 of the third side 120 of clip 110, and slotted opening 112 of leg 108 of bus bar fuse 106. A portion of fastener 124 is surrounded about its periphery by threaded through-hole 116 of first side 114 and through-hole 122 of third side 120 to retain fastener 124 within slotted opening 112 of leg 108. Fastener 124 includes a threaded portion 126, wherein the diameter of through-hole 122 of third side 120 is larger than the diameter of threads of fastener 124 to provide clearance for threaded portion 126 of fastener 124 to pass through. Threaded portion 126 corresponds to threads of threaded through-hole 116 of first side 114 such that to pass through threaded through-hole 116 fastener 124 must be rotated. Threaded through-hole 116 provides the captivation of fastener 124 within clip 110, because once fastener 124 has been threaded through, first side 114 of clip 110 is sandwiched between a head 123 and threaded portion 126 of fastener 124, thereby retaining fastener 124 within clip 110 until fastener 124 is unthreaded.

Figure 3:
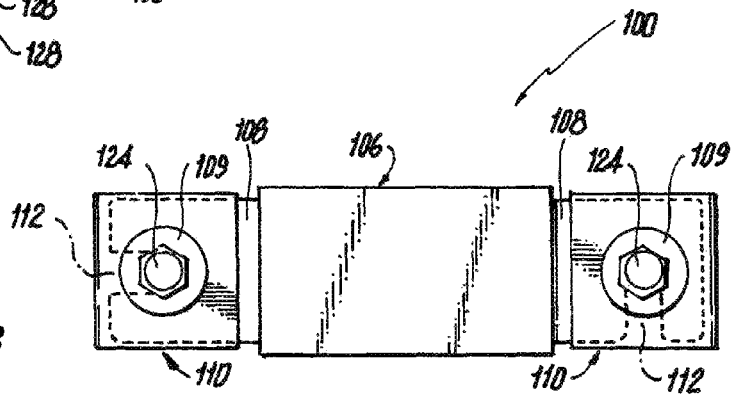
FIG. 3 is a schematic plan view of the fuse assembly of FIG. 1, showing the slotted openings of the legs.

As shown in FIGS. 2 and 3, clip 110 is configured to retain fastener 124 within leg 108 of bus bar fuse 106 when not threaded into fuse mounting block body assembly 102. It is contemplated that fuse assembly 101 can include a washer 109 between a head of fastener 124 and clip 110. Clip 110 captivates fastener 124 thereby also controlling the location of washer 109. At least one of first and third sides, 114 and 120, respectively, includes a lip 128 to guide clip 110 onto bus bar fuse 106 and to restrict motion of clip 110 when assembled onto bus bar fuse 106. Lip 128 extends from first side 114 of clip 110 toward the third side of clip 110, and/or from third side 120 of clip 110 toward first side 114 of clip 110. Slotted opening 112 of leg 108 opens in a direction facing away from second side 118 of clip 110, and/or in a direction ninety degrees from second side 118 of clip 110.

A method for assembling a fuse block, e.g. fuse block assembly 100, includes providing a fuse mounting block body assembly, e.g. fuse mounting block body assembly 102, having a threaded female mating portion, e.g. threaded female mating portion 104, extending therefrom. The method includes sliding a clip, e.g. clip 110, around a portion of a leg of a bus bar fuse, e.g. leg 108 of bus bar fuse 106, compressing clip 110 around leg 108, and threading a fastener, e.g. fastener 124, into clip 110. Threading fastener 124 into clip 110 includes threading fastener 124 through threaded through-hole, e.g. threaded through hole 116, of the first side of clip 110, e.g. first side 114.

Once clip 110 and fastener 124 have been assembled into leg 108 of bus bar fuse 106, the method includes aligning fastener 124 with a threaded hole, e.g. threaded hole 105, of threaded female mating portion 104 of fuse mounting block body assembly 102 and threading fastener 124 into threaded hole 105, thereby operatively connecting clip 110 and bus bar fuse 106 to fuse mounting block body assembly 102 forming fuse block assembly 100. It is contemplated that the method can include installing a washer, e.g. washer 109, around fastener 124 before threading fastener 124 into clip 110.

The methods and systems of the present disclosure, as described above and shown in the drawings, provide for captivation of fasteners onto legs of commercial/aerospace high amperage fuses, reducing assembly error and reducing the potential for foreign object damage due to lost hardware.

While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A fuse assembly comprising:

a bus bar fuse having a leg with a slotted opening; and a clip surrounding a portion of the leg, wherein the clip includes:

a first side having a threaded through-hole;

a second side extending from the first side at an angle with respect to the first side; and a third side extending from the second side at an angle with respect to the second side, wherein the third side includes a through-hole, wherein at least one of the first or third sides includes a lip to guide the clip onto the bus bar fuse and to restrict motion of the clip when assembled onto the bus bar fuse.

2. A fuse assembly as recited in claim 1, wherein the lip extends from the first side of the clip toward the third side of the clip.

3. A fuse assembly as recited in claim 1, wherein the lip extends from the third side of the clip toward the first side of the clip.

4. A fuse assembly as recited in claim 1, wherein the slotted opening of the leg opens in a direction facing away from the second side of the clip.

5. A fuse assembly as recited in claim 1, wherein the slotted opening of the leg opens in a direction ninety degrees from the second side of the clip.

6. A fuse assembly as recited in claim 1, further comprising a fastener passing through the threaded through-hole of the first side of the clip, the through-hole of the third side of the clip, and the slotted opening of the leg of the bus bar fuse, wherein a portion of the fastener is surrounded about its periphery by the threaded through-hole of the first side and the through-hole of the third side to retain the fastener within the leg of the bus bar fuse.

7. A fuse assembly as recited in claim 6, wherein the fastener includes a threaded portion, wherein the diameter of the through-hole of the third side is larger than the diameter of threads of the fastener to provide clearance for the threaded portion of fastener to pass through.

8. A fuse assembly as recited in claim 6, wherein the fastener includes a threaded portion that corresponds to threads of the threaded through-hole of the first side such that to pass through the threaded through hole the fastener must be rotated.

9. A fuse block assembly:

a fuse mounting block body assembly having a threaded female mating portion extending therefrom;

a bus bar fuse including a leg operatively connected to the fuse mounting block body assembly;

a clip surrounding a portion of the leg, wherein the clip includes:

a first side having a threaded through-hole;

a second side extending from the first side at an angle with respect to the first side; and a third side extending from the second side at an angle with respect to the second side, wherein the third side includes a through-hole, wherein at least one of the first or third sides includes a lip; and a fastener threaded into the fuse mounting block body assembly, wherein the fastener passes through the threaded through-hole of the first side of the clip, the through-hole of the third side of the clip, and the slotted opening of the leg of the bus bar fuse, wherein a portion of the fastener is surrounded about its periphery by the threaded through-hole of the first side and the through-hole of the third side to retain the fastener within the leg of the bus bar fuse when not threaded into the fuse mounting block body assembly.

10. A fuse block assembly as recited in claim 9, wherein the threaded female mating portion is a cylindrical electrical post with a threaded hole therethrough.

11. A fuse block assembly as recited in claim 9, wherein the fastener includes a threaded portion, wherein the diameter of the through-hole of the third side is larger than the diameter of threads of the fastener to provide clearance for the threaded portion of fastener to pass through.

12. A fuse block assembly as recited in claim 9, wherein the fastener includes a threaded portion that corresponds to threads of the threaded through-hole of the first side such that to pass through the threaded through hole the fastener must be rotated.

13. A fuse block assembly as recited in claim 9, wherein the slotted opening of the leg opens in a direction facing away from the second side of the clip.

14. A fuse block assembly as recited in claim 9, wherein the slotted opening of the leg opens in a direction ninety degrees from the second side of the clip.

* * * * *